US005953196A

United States Patent [19]

Zimmermann

[11] Patent Number: 5,953,196

[45] Date of Patent: Sep. 14, 1999

[54] METHOD AND APPARATUS FOR AN ELECTROMAGNETIC JOYSTICK LOCK WITH FLUX CANCELING DRIVER CIRCUIT

[75] Inventor: Daniel E. Zimmermann, Peoria, Ill.

[73] Assignee: Caterpillar Inc., Peoria, Ill.

[21] Appl. No.: 09/122,003

[22] Filed: Jul. 24, 1998

[51] Int. Cl.[6] ..... H01H 47/04

[52] U.S. Cl. ..... 361/144; 307/101; 361/149

[58] Field of Search ..... 361/143, 144, 361/145, 146, 245, 149; 335/284, 285, 295, 289; 414/699; 307/101

[56] References Cited

U.S. PATENT DOCUMENTS

| | | | |
|---|---|---|---|
| 3,735,221 | 5/1973 | Bell et al. | 318/151 |
| 4,318,155 | 3/1982 | Thomas | 361/156 |
| 4,392,543 | 7/1983 | Buckhouse et al. | 180/272 |
| 4,576,262 | 3/1986 | Mohan et al. | 192/18 B |
| 4,604,675 | 8/1986 | Pflederer | 361/155 |
| 5,062,509 | 11/1991 | Carpenter et al. | 192/4 A |
| 5,229,902 | 7/1993 | Zucker et al. | 360/114 |
| 5,467,244 | 11/1995 | Jayawant et al. | 361/144 |
| 5,467,541 | 11/1995 | Greer et al. | 37/348 |
| 5,684,407 | 11/1997 | Zdanys, Jr. et al. | 324/714 |
| 5,813,712 | 9/1998 | Mozelt | 294/65.5 |

*Primary Examiner*—Jeffrey Gaffin
*Assistant Examiner*—Kim Huynh
*Attorney, Agent, or Firm*—W. Bryan McPherson

[57] ABSTRACT

The locking force of an electromagnetic joystick lock with flux having a flux canceling driver circuit is controlled in order to maintain the control lever of a joystick in a desired position. In one embodiment, the locking force may be in either an activated or deactivated state, and one of a forward or reverse current is applied to the coils of the lock in response to the state, in order to eliminate the residual magnetism when the locking force is deactivated.

13 Claims, 5 Drawing Sheets

METHOD AND APPARATUS FOR AN ELECTROMAGNETIC JOYSTICK LOCK WITH FLUX CANCELING DRIVER CIRCUIT

TECHNICAL FIELD

The present invention relates generally to an electromagnetic joystick on an earthmoving machine, and more particularly, to an apparatus and method for controlling a locking force applied to a control handle of an electromagnetic joystick in order to maintain the control handle in a desired position.

BACKGROUND ART

Earthmoving equipment, such as bull dozers, may include joystick handles to control the direction and speed of the machine. For example, moving the joystick to the left or right may control the direction of the machine, while moving the joystick fore or aft may control the velocity. Operators desire a way to hold the joystick in a desired position for an extended period of time, for example, when dozing in a specific direction. When moving in the same direction for an extended period of time operators do not want to have to concentrate on holding the joystick steady. Therefore, systems have been developed that enable the operator to lock the joystick in a particular position while moving. An electromagnetic lock may be used to perform the locking function. In general, the electromagnetic lock includes two coils which, when energized, create a magnetic field locking the joystick in place. When the operator turns the electromagnetic lock off they desire the joystick to return to the center position. Having the joystick return to center position is important when the operator applies the brakes, or disengages the cruise control of the machine. When the electromagnetic lock is disengaged the operator needs to manually control the direction of the machine. However, current electromagnetic locks have a residual magnetism when they are turned off. The residual magnetism continues to create an electromagnetic force even though the lock has been disengaged. The residual magnetism makes it difficult for an operator to restore manual control of the machine because the residual force holds the joystick off neutral.

In addition, operators need multiple levels of forces applied to the joystick depending on what operation the machine is performing. For example, if the operator is moving to another location they may want a large level of force applied to the joystick because the machine does not need to make velocity changes; and, therefore, a force can be applied which will hold the joystick in place despite the vibration the joystick experiences. On the other hand, if the operator is moving dirt from one location to another during dozing, the operator may want an intermediate level of force applied to the joystick so that the operator may make small velocity corrections of the machine without having to disengage the cruise control, which disengages the locking force. Therefore, multiple levels of force are desirable, and the force applied needs to be selected by the operator.

The present invention is directed to overcoming one or more of the problems set forth above.

DISCLOSURE OF THE INVENTION

In one aspect of the present invention, an apparatus for controlling a locking force applied to a control handle of an electromagnetic joystick in order to maintain the control handle in a desired position is disclosed. The apparatus includes an activation means for controlling the actual state of the locking force, and a force controlling means for generating one of a first force signal and a second force signal in response to the actual state.

In another aspect of the present invention, an apparatus for controlling a locking force applied to a control handle of an electromagnetic joystick in order to maintain the control handle in a desired position is disclosed. The apparatus includes an activation controller adapted to control the actual state the of the locking force, and a force controller adapted to generate one of a first force signal and a second force in response to the actual state is disclosed.

In yet another aspect of the present invention a method for controlling a locking force applied to a control handle in order to maintain the control handle in a desired position is disclosed. The method includes the steps of determining the actual state of the locking force, and generating either a first or second force signal in response to the state of the locking force.

BEST MODE FOR CARRYING OUT THE INVENTION

The present invention includes a method and apparatus adapted to control a locking force that is applied to a control lever of an electromagnetic joystick. The locking force is applied to the control lever in order to hold the control lever in a desired position.

Figure 1:
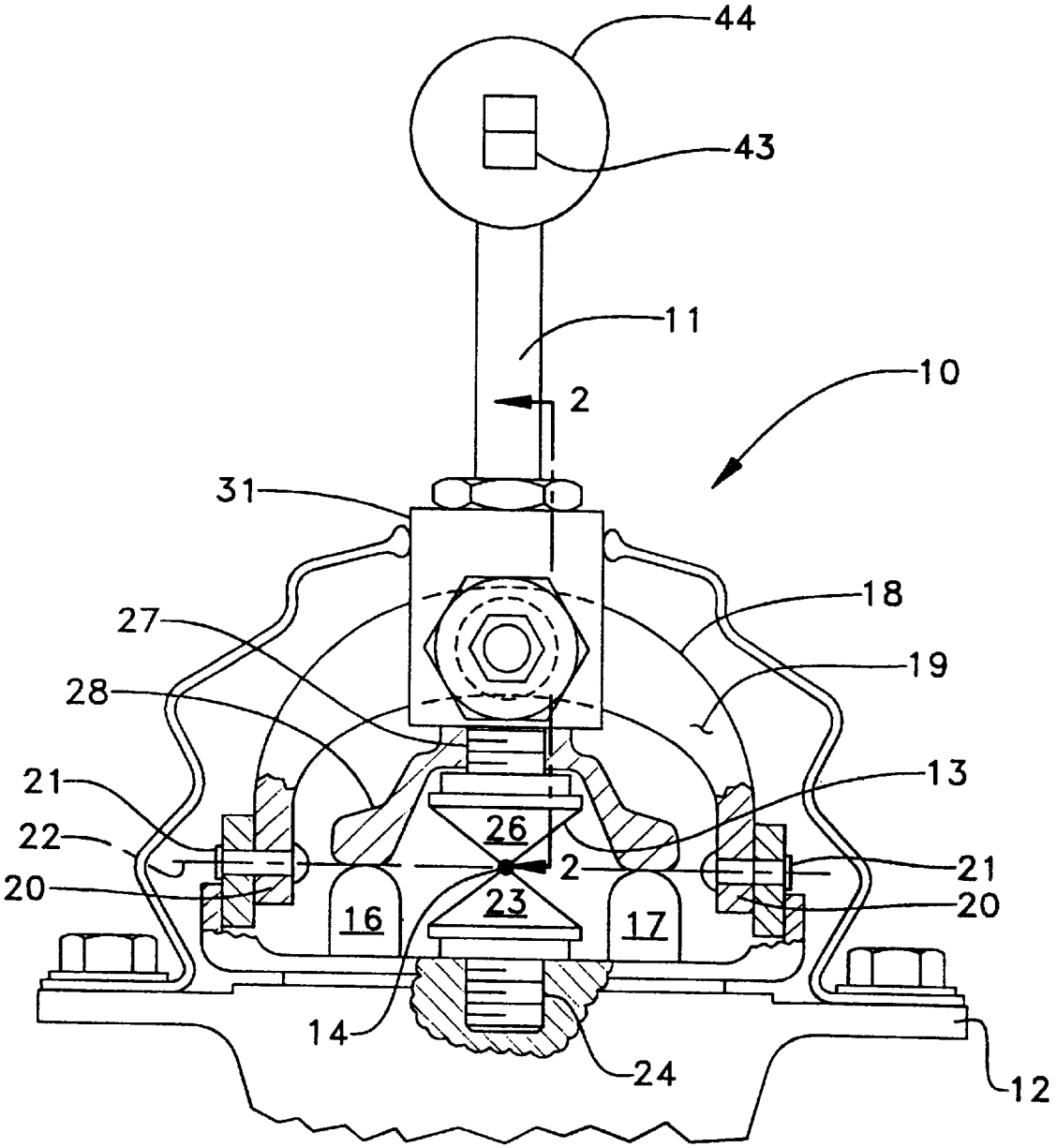
FIG. 1 is a cross-sectional view illustrating the principles of the present invention.

FIG. 1 illustrates one embodiment of an electromagnetic joystick. As seen in FIG. 1 a variable position detent mechanism 10 is shown in combination with a control lever 11 for retaining the control lever 11 at one of an infinite number of actuated positions. The control lever 11 in this application is a joystick and is connected to a support 12 through a universal coupling 13 for pivotal movement about a pivot 14. The support can be, for example, a component of either a hydraulic or electrical control means. In the illustrated embodiment a pilot valve is shown having a plurality of plungers, two of which are shown at 16,17 extending through the support on opposite sides of the universal coupling 13. The other two plungers are typically located at 90° from the plunger 16,17. The plungers are spring biased to the position shown for centering the control lever at a neutral position.

The detent mechanism 10 includes a semicircular member 18 having generally planar opposing sides 19 and opposite ends 20. The opposite ends 20 are pivotally connected to the support with a pair of axially aligned pivot pins 21 located having an axis 22 passing through the pivot 14.

The universal coupling 13 includes a first end 23 having a threaded portion 24 threadably engaging the support 12 and a second end 26 having a threaded portion 27 threadably engaging a bell shaped actuating member 28. In this application the connection between the support 12 and the control lever 11 is described as a universal coupling 13. However, it should be understood that any arrangement that allows the control lever 11 to move relative to two perpendicular axes is acceptable without departing from the spirit of the invention.

Figure 2:
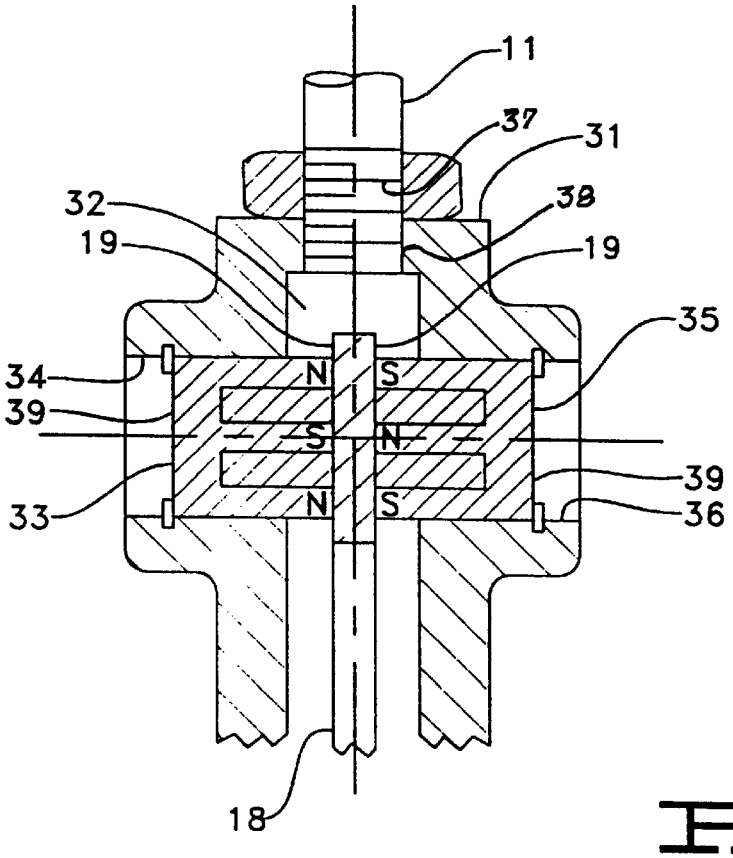
FIG. 2 is a view taken generally along line 2—2 of FIG. 1.

The threaded portion 27 of the universal coupling 13 also threadably engages a carrier 31 having an opening 32 which receives the semi-circular member 18. As seen in FIG. 1 and FIG. 2, a first detent-coil 33 is disposed in a hole 34 on one side of the carrier 31, adjacent and in close proximity to one of the generally planar opposing sides 19 of the semi-circular member 18. A second detent-coil 35 is disposed in a hole 36 on the other side of the carrier 31, adjacent and in close proximity to the other generally planar opposing sides 19 of the semi-circular member 18. The first detent-coil 33 and the second detent-coil 35 are also positioned in co-axial alignment with one another on opposite sides of the semi-circular member 18. A threaded portion 37 of the lever 11 threadably engages a threaded hole 38 in the carrier 31 so that the lever 11, the carrier 31, the first detent-coil 33, the second detent-coil 35, and the actuator 28 pivot in unison about the pivot 14.

FIG. 2 shows one arrangement for the first detent-coil 33 and the second detent-coil 35. In this arrangement the first detent-coil 33 and the second detent-coil 35 are free floating in their respective holes 34,36. The first detent-coil 33 and the second detent-coil are for example electromagnets 39. The electromagnets 39 are wired together so that when energized their respective poles act in opposition to one another to increase the magnetic field therebetween.

Figure 3:
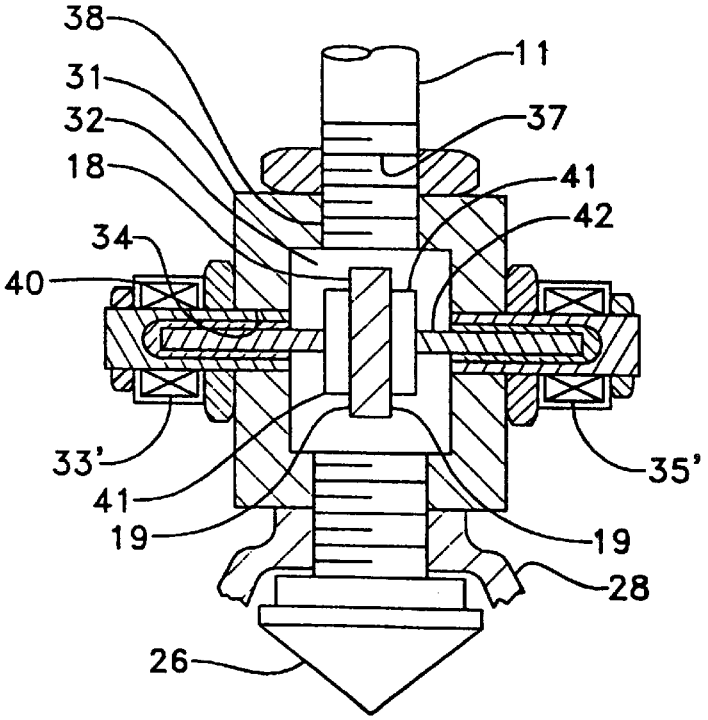
FIG. 3 is a view taken generally along line 2—2 of FIG. 1 similar to FIG. 2 illustrating an alternative embodiment of the present invention

In FIG. 3 an alternative arrangement of the first detent-coil 33' and the second detent-coil 35' is shown. In this arrangement the first detent-coil 33' and the second detent-coil 35' are solenoids 40. A friction element 41 is attached to the end of a plunger 42 of each of the solenoids 40. The plungers 42 are suitably biased in the open position keeping the friction elements 41 away from the circular member 18. When the first detent-coil 33' and the second detent coil 35' are electrically actuated, the plungers 37 move the friction elements 41 into contact with each of the generally planar sides 19 of the semi-circular member 18.

A toggle switch 43 is suitably mounted to a handle 44 (FIG. 1) at the distal end of the lever 11 and is connected to the first detent-coil 33,33' and the second detent-coil 35, 35' through a lead 45.

Figure 4:
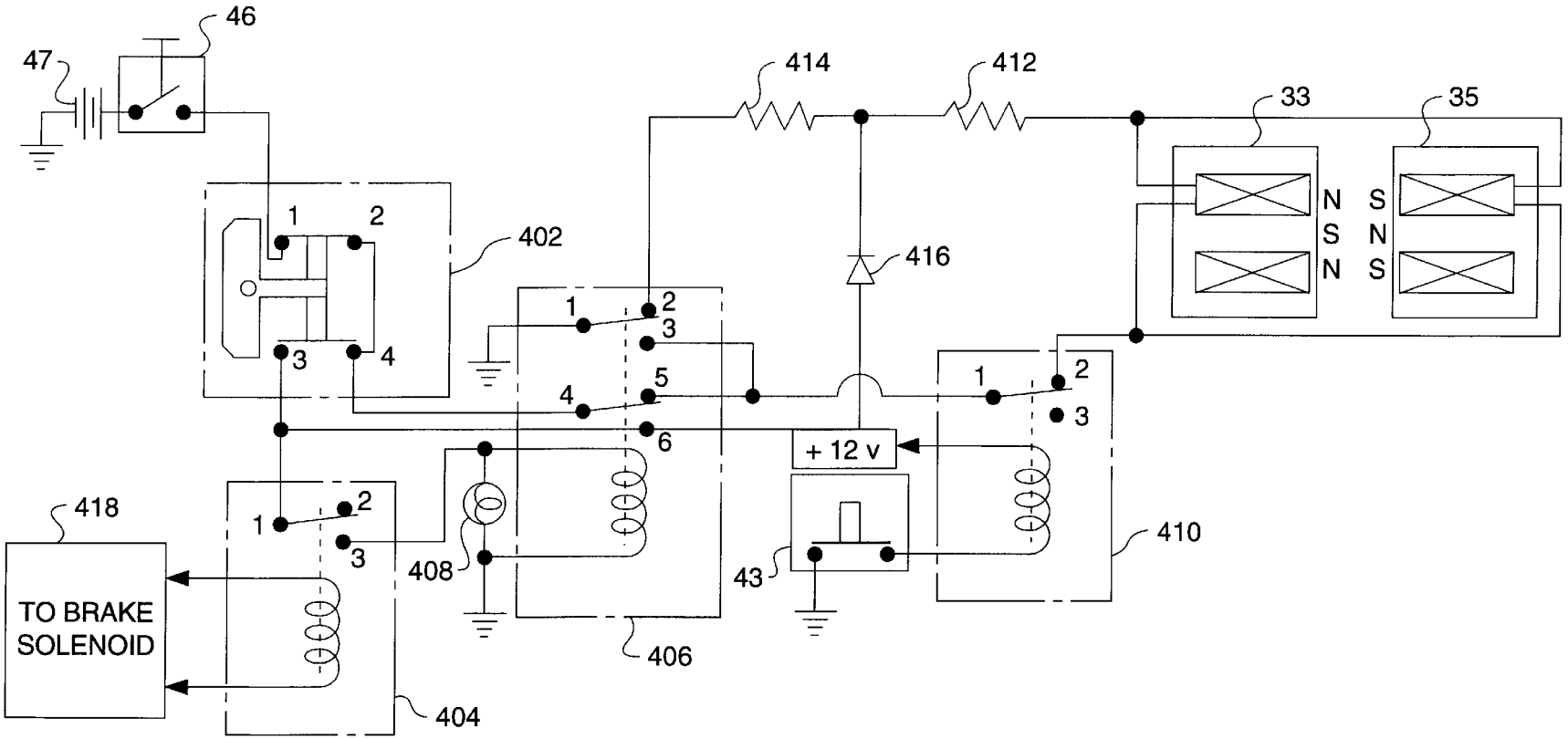
FIG. 4 is a schematic illustration of an electric circuit utilized in the present invention.

The present invention includes an apparatus adapted to control the locking force applied to the control lever 11. FIG. 4 illustrates one embodiment of the present invention. The apparatus includes a cruise control switch 402 connected in series to a engine switch 46, which in turn is connected in series to a battery 47. The cruise control switch 402 may be a rocker switch, such as a Carling switch, or a toggle switch. The operator toggles the switch 402 to turn the cruise control mode on and off.

Contact 3 of the cruise control switch 402 is connected to contact 1 of an interlock relay 404, and contact 6 of an double pull double throw relay 406. Contact 4 of the cruise control switch 402 is also connected to a contact 4 of a double pull double throw relay 406. An interlock relay having part number 3E-9362 is an example of one embodiment of the interlock relay 404, 410, and 602 (of FIG. 6). An double pull, double throw relay having part number 3E7572 is an example of one embodiment of the double pull, double throw relay 406.

The coil of the interlock relay 404 is connected across a brake solenoid 418. The coil of the relay 404 is normally energized. When the brakes are activated the coil of the relay 404 is not energized. Contact 2 of the interlock relay 404 is left open. Contact 3 of the interlock relay 404 is connected to the coil of the double pull double throw relay 406. In the preferred embodiment an indicator lamp 408 is connected between contact 3 of the interlock relay 404 and ground. The lamp 408 will light when the coil of the double pull double throw relay 406 is being energized.

Contact 4 of the double pull double throw relay 406 is connected to contact 1 of the interlock relay 410. The coil of the interlock relay 410 is connected between a voltage source and a toggle switch 43. The toggle switch 43 is located on the handle 44 of the lever 11, and is connected between the coil of the interlock relay 410 and ground. The toggle switch 43 is normally open. Contact 2 of the interlock relay 410 is connected to the first detent-coil 33 and the second detent-coil 35.

Contact 2 of the double pull double throw relay 406 is connected to the first and second detent coils 33, 35 through two resistors 414, 412 connected in series. Contact 6 of the double pull double throw relay 406 is connected to contact 2 of the relay 406 through a diode 416 and resistor 414. Example values for resistors 414, 412 are 38 ohms/4 Watts and 1.5 ohm/15 Watts respectively. A diode having part number 9P9057 is an example of one embodiment of the diode 416. Contact 3 and 5 of the double pull double throw relay are connected to contact 1 of the interlock relay 410.

The apparatus of the invention includes an activation means, or activation controller, for controlling the actual state of the locking force to be applied to the control lever 11. The actual state may be either activated or deactivate. In the preferred embodiment the activation means includes the cruise control switch 402 and the interlock relay 404. The state of the cruise control switch 402 and the interlock relay 404 control the state of the locking force generated by the first and second detent coils 33, 35. That is, if the cruise control switch 402 is toggled on, and the brakes are not activated, then the locking force is activated. If either the cruise control switch 402 is toggled off, or the brakes are activated, the locking force is deactivated. In an alternative embodiment the activation means, or activation controller, may also include an engine switch 46 or the unlatch button 43.

The apparatus of the invention also includes a force controlling means, or force controller, for applying either a first force signal or a second force signal to the first and second detent coils 33, 35. As will be described, in the preferred embodiment, the force controller includes circuitry such as the double pull double throw relay 406, resistors 414, 412 and diode 416. In one embodiment of the present invention, the objective of the force controlling means is to control the direction of the current being applied to the first and second detent coils 33, 35, applying a first force signal to the coils 33, 35 if the locking force is activated, and a second force signal if the locking force is deactivated. If the state of the locking force is activated, then the force controlling means will apply a forward current to the first and second detent coils 33, 35. If the state of the locking force is deactivated, the force controlling means will apply a reverse current to the first and second detent coils 33, 35.

FIG. 4 illustrates the present invention prior to being activated. The engine (not shown) is running, thereby switch 46 is closed. The brakes are normally not activated, therefore, the coil of the interlock relay 404 is energized, thereby closing the connection between the center contact 1 and contact 3 of the relay 404. If the brakes are activated, then the connection between contact 1 and 3 of the relay 404 is opened. If the cruise control switch 402, has not been toggled, then the switch 402 is open and the coil of the double pull double throw relay 406 is not energized. Therefore, the center contacts 1 and 4 of the double pull double throw relay are connected to contacts 2 and 5 of the relay, respectively.

Figure 5:
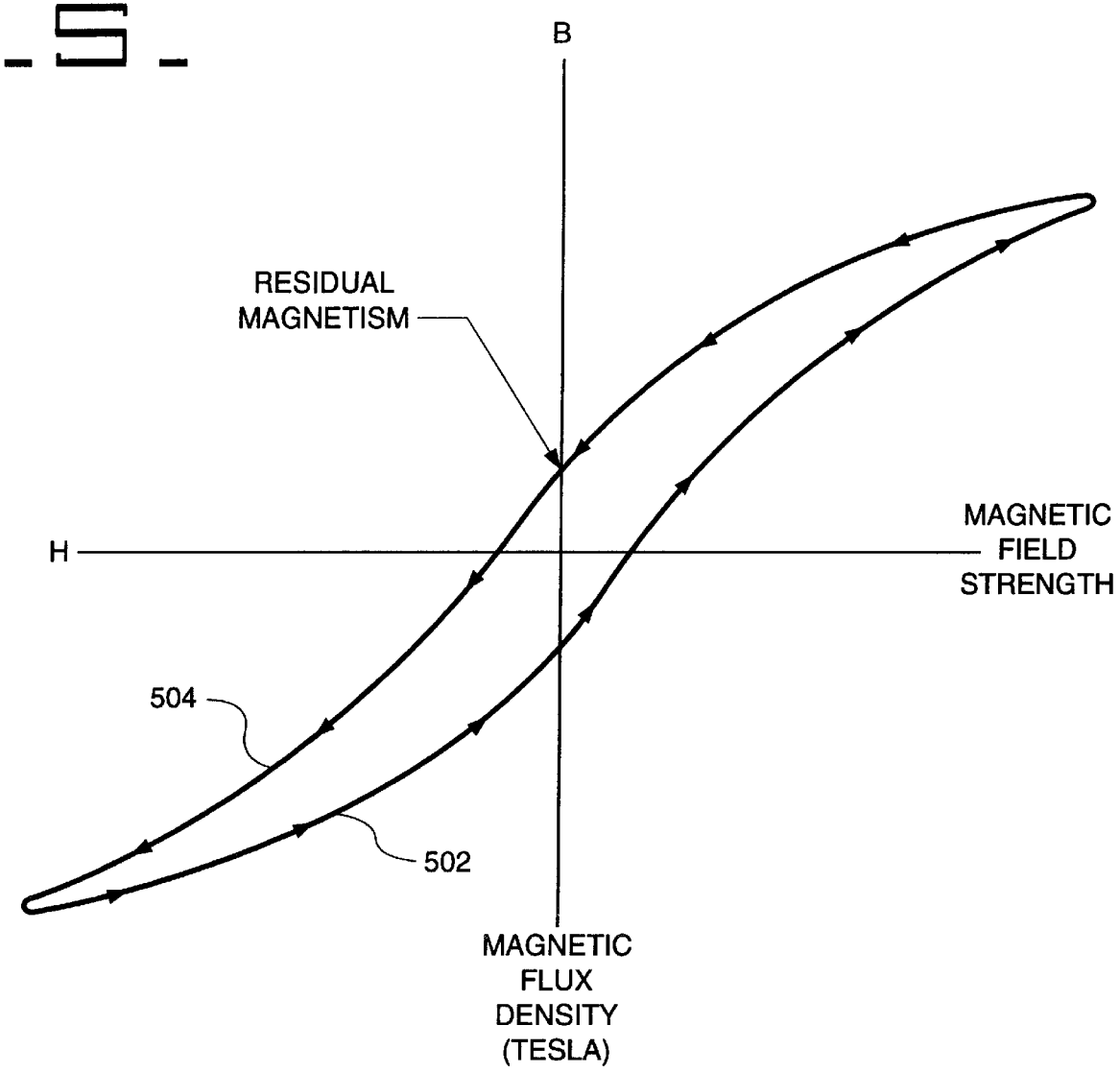
FIG. 5 is an illustration of a magnetic flux density map corresponding to the present invention.

When the cruise control switch 402 is toggled, or turned on, current flows through the interlock relay 404 and through the coil of the double pull double through relay. When the coil of the relay 406 is energized the center contacts 1 and 4 are connected to contacts 3 and 6 respectively, and the first and second detent coils 33, 35 are energized. The current flows through the cruise control switch 402, through contacts 4 and 6 of the double pull double through relay 406, through the diode 416 and the resistor 412, through the first and second detent coils 33, 35, through interlock relay 410 via contacts 2 and 1, and then to ground through contacts 3 and 1 of the double pull double through relay 406. The increase in magnetic field density in the first and second detent coils is illustrated by a first magnetic flux density graph 502 of FIG. 5.

In operation, the first detent-coil 33,33' and the second detent-coil 35,35' are energized when the cruise control switch 402 is toggled on, the engine switch 46 is closed, and the brakes are not activated. Energizing the first detent-coil 33,33' and the second detent-coil 35,35' creates an electromagnetic field securing the lever 11 with respect to the semi-cylindrical member 18 and can be done at any operative position of the lever 11. To reset the lever 11 at another operating position, the operator can open the switch 43 to de-energize the first detent-coil 33,33' and the second detent-coil 35,35', thereby removing the current and unlatching the lever 11 from the semi-circular member 18 so that the lever 11 can be moved to the new operating position. The lever 11 can be re-latched to the semi-circular member 18 at the new position by closing the switch 43 to re-energize the first detent-coil 33,33' and the second detent-coil 35,35'. Optionally, the lever can be reset by physically overpowering the electrical latch force generated by the detent coils 33,33' and 35,35'. Moreover, should the lever 11 be latched in a operating position when the switch 46 is opened, the cruise control switch 402 is toggled off, or the brakes are deactivated, the detent-coils 33,33' and 35,35' would be current reversed, allowing the return springs of the mechanism to return the lever 11 to the neutral position.

When the first and second detent coils are energized, and then the circuit is broken, for example when the brakes are activated or the cruise control is toggled off, there is still residual magnetism created by the first and second detent coils 33, 35, creating a locking force that is applied to the control lever 11. Under the conditions of the machine being turned off, or the control lever being repositioned the residual force may be acceptable. However, when cruise control is turned off, or the brakes are activated, the operator of the machine must manually guide the machine using the joystick. Therefore, it is important to have no residual magnetic locking force. In order to eliminate the residual locking force when the cruise control is turned off, or the brakes are activated the present invention reverses the current through the first and second detent coils 33, 35. Reversing the current through the first and second detent coils 33, 35 will reduce the magnetic flux density as illustrated by curve 504 of FIG. 5.

When the brakes are activated, the coil of relay 404 is de-energized thereby opening the connection between contact 1 and 3 of the relay 404. Therefore, the coil of relay 406 is not energized, and contact 4 of relay 406 is connected to contact 5, and contact 1 is connected to contact 2. The current flows through the cruise control switch 402 as before, through contact 4 and contact 5 of the double pull double throw relay 406, through the first and second detent coils, through the two resistors 414, 412, through contact 2 and 1 of the double pull double through relay 406, and to ground. Therefore, the direction of the current is reversed through the first and second detent coils 33, 35 eliminating the residual magnetism.

Alternatively, if the cruise control switch is toggled, turning the cruise control off, current no longer flows through the coil of the double pull, double through relay via contact 3 of the cruise control switch. Therefore, the coil is not energized and contact 1 and contact 4 of the double pull double throw relay 406 are connected to contact 2 and contact 5 of the relay 406 respectively. As described above, the flow of current through the first and second detent coils is reversed. In this manner the residual magnetism created by the first and second detent coils is eliminated, enabling the control lever to return to center.

Figure 6:
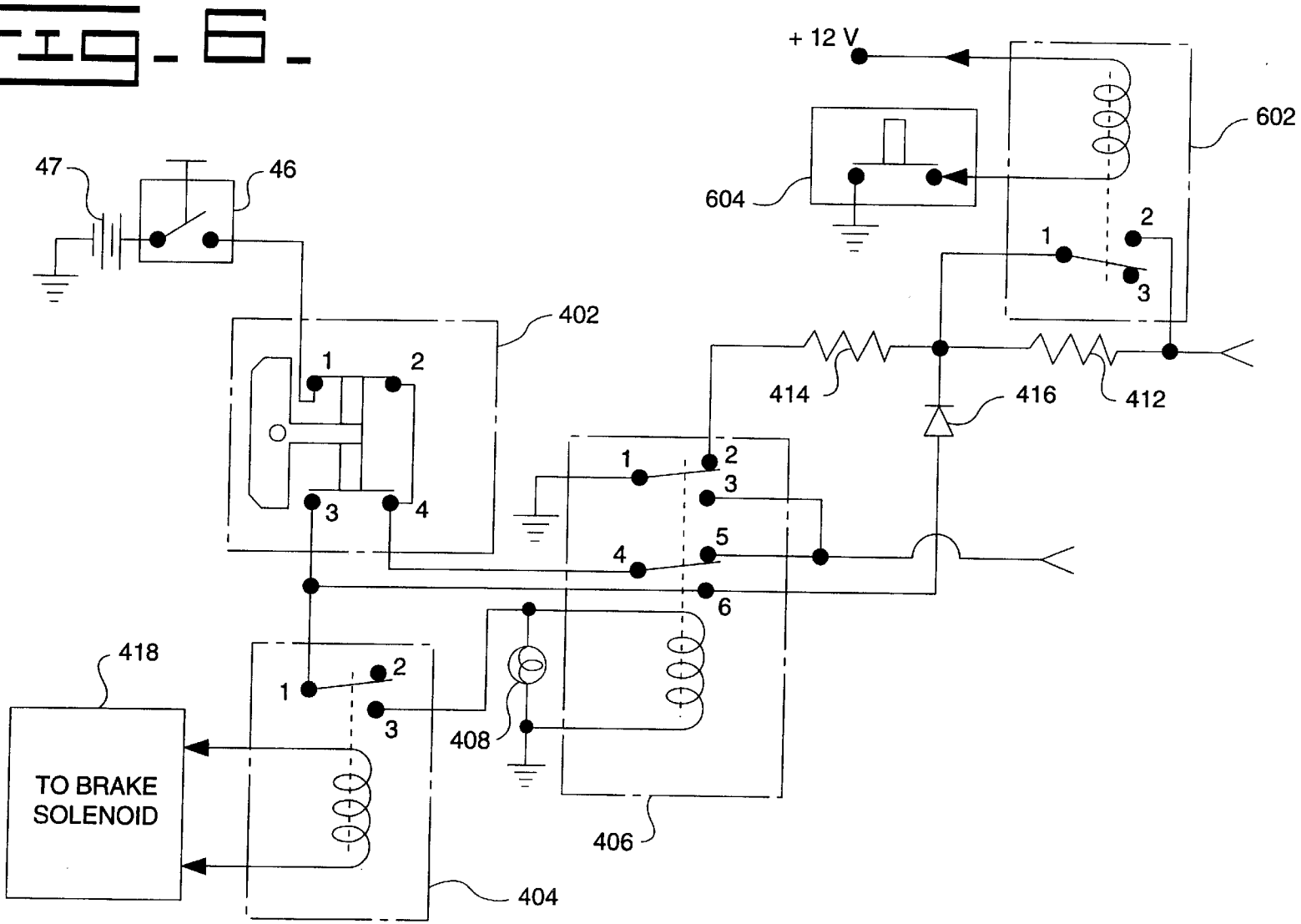
FIG. 6 is a schematic illustration of an alternative embodiment electric circuit that may be utilized in the present invention.

In an alternative embodiment, two different forward current levels may be applied to the first and second detent coils 33, 35, creating two different levels of forces to the joystick. For example, when the operator is roading, or moving the machine from one location to the other, the operator needs a strong locking force because they don't want the control lever to move, and they don't need to continue to move the control lever during travel. However, when an operator is pushing dirt, they need a locking force strong enough to maintain the position but not so strong that they can't manually adjust the position of the control lever during the course of travel. Therefore, the invention includes a force magnitude selection means, or force magnitude selector, for controlling the magnitude of the first force being applied by the coils to the control lever. One embodiment of a force magnitude selection means includes a toggle switch 604 and an interlock relay 602 as illustrated in FIG. 6. The embodiment illustrated in FIG. 6 provides two levels of locking force selectable by the operator. The circuit illustrated in FIG. 6 provides an interlock relay 602 in parallel with the resistor 412. The coil of the interlock relay 602 is connected to an operator selectable force control switch 604. In the preferred embodiment the force control switch 604 is a toggle switch. When the rabbit mode is selected, i.e., the force control switch 604 is closed, the coil of the relay 602 is energized and contact 1 of the relay 602 is connected to contact 2. Therefore, the resistor 412 is shunted providing one current level to the first and second detent coils. When the turtle mode is selected, the force control switch 604 is open, the coil of the relay 602 is no longer energized. Therefore, the contact 1 is connected to contact 3 and the current does not flow through the relay, but rather through the resistor 412. Therefore, a second current level, less than the first is provided to the first and second detent coils. Therefore, the second force is less than the first force. In the preferred embodiment, the first current level may be 2 amps, and the second current level 1 amp.

In an alternative embodiment the interlock relay 602 may be replaced with a potentiometer. Therefore, the operator may create the desired force on the control lever by manually adjusting the value of the potentiometer. The operation of the remaining portion of the circuit is analogous to the circuit shown in FIG. 4. Specifically, when the cruise control switch 402 is toggled off, or the brakes are activated, current flowing through the first and second detent coils 33, 35 is reversed.

INDUSTRIAL APPLICABILITY

With reference to the drawings and in operation, the present invention is adapted to provide an apparatus and method controlling the locking force applied to a control lever of an electromagnetic joystick in order to maintain the control lever in a desired position. In the preferred embodiment the apparatus includes a means for determining the actual state of the locking force as being either activated or deactivated. The apparatus also includes a force controlling means for applying either of forward or reverse current to the coils of the electromagnetic lock in order to eliminate the residual magnetism when the locking force is deactivated.

In operation, the operator of an earthmoving machine may engage the cruise control of the machine. When the cruise control is engaged, a locking force is applied to the control handle of the joystick in order to hold it in a desired position. If the operator wishes to adjust the position of the joystick they may press down on an unlatch button, located on the control lever, to reposition the joystick. When the unlatch button is released, the locking force is again applied to the control lever. When either the cruise control is toggled off, or the brakes are activated, a current is applied to the coils of the joystick, in the opposite direction of the first current. The purpose of reversing the current is to eliminate any residual magnetism that is created in the steel of the machine that will prevent the joystick from returning to center. The operator may then easily obtain manual control of the machine.

In an alternative embodiment, when the cruise control is on, the operator may select between at least two force levels that may be applied the control handle of the joystick. If the operator is in the dozing process they may select a smaller force in order to fine tune the positioning of the control handle as the machine dozes. If the operator is traveling for an extended period of time the operator may select a larger force so that the joystick will not change position due to ground vibrations created during travel.

I claim:

1. An apparatus for controlling a locking force applied to a control lever of an electromagnetic joystick by at least two coils of the joystick in order to maintain the control lever in a desired position, comprising:

an activation means for determining an actual state of the locking force, said state being one of an activated state and a deactivated state; and, a force controlling means for applying one of a first force signal and a second force signal to said coils in response to said actual state, said second force signal being opposite polarity said first, said force controlling means including a relay, said relay being adapted to control the application of one of said first and said second force signals in response to said state, said second force signal being applied in order to neutralize a residual magnetism.

2. An apparatus, as set forth in claim 1, wherein said force controlling means is further adapted for applying said first force signal in response to said actual state being said activated, and said second force signal in response to said actual state being said deactivated.

3. An apparatus, as set forth in claim 2, further comprising:

a force magnitude selection means adapted to enable an operator to control the magnitude of said first force being applied by the coils to the control lever.

4. An apparatus, as set forth in claim 2, wherein said first force signal and said second force signal are direct current signals.

5. An apparatus, as set forth in claim 4, wherein said first force signal creates a magnetic field when applied to said coils, and said second force signal neutralizes said field upon application to said coils.

6. An apparatus, as set forth in claim 5, wherein said activation means includes a cruise control switch and a brake relay, said brake relay being adapted to deactivate said state when a brake is applied.

7. An apparatus, as set forth in claim 6, including an operator indicator adapted to indicate said state of said locking force to an operator.

8. An apparatus for controlling a locking force applied to a control lever of an electromagnetic joystick by at least two coils of the joystick in order to maintain the control handle in a desired position, comprising:

an activation controller adapted to control an actual state of the locking force, said actual state being one of an activated and a deactivated state;

a force controller adapted to generate a first force signal in response to said actual state of the locking force being said activated and a second force signal in response to said actual state of the locking force being said deactivated and responsively delivering one of said first and second force signal to the coils, said second force signal being generated to neutralize a residual magnetism; and a force magnitude selector adapted to control the magnitude of said first force being applied by the coils to the control lever; thereby controlling the locking force applied to said control handle.

9. An apparatus, as set forth in claim 8, wherein said activation controller is further adapted to determined a desired state of the locking force, said desired state being one of an activated and a deactivated state, and responsively controlling said actual state of the locking force.

10. An apparatus, as set forth in claim 9, further comprising:

a force magnitude selector adapted to control the magnitude of said first force being applied by the coils to the control lever.

11. An apparatus, as set forth in claim 8, wherein said force controller means includes a relay adapted to control the application of one of said first and said second control signals in response to said state, said second control signal being applied when said state is deactivated.

12. An apparatus, as set forth in claim 11, wherein said first force signal and said second force signal are direct current signals.

13. A method for controlling a locking force applied to control lever of an electromagnetic joystick by at least two coils of the joystick in order to maintain the control handle in the desired position, comprising:

determining actual state of the locking force is one of an activated state and a deactivated state;

generating one of a first force signal and a second force signal in response to said actual state; said second force signal being generated to neutralize a residual magnetism, controlling the magnitude of said first force signal in response to an operator selected desired force input; and delivering one of said first and second force signal to the coils; thereby controlling the locking force applied to the control handle.

* * * * *